US005701707A

United States Patent [19]

Sorkin

[11] Patent Number: 5,701,707

[45] Date of Patent: Dec. 30, 1997

[54] BONDED SLAB POST-TENSION SYSTEM

[76] Inventor: Felix L. Sorkin, P.O. Box 1503, Stafford, Tex. 77477

[21] Appl. No.: 642,853

[22] Filed: May 6, 1996

[51] Int. Cl.[6] ..... E04C 5/12

[52] U.S. Cl. ..... 52/223.13; 52/223.6; 52/223.14

[58] Field of Search ..... 52/223.6, 223.13, 52/223.14

[56] References Cited

U.S. PATENT DOCUMENTS

| | | | |
|---|---|---|---|
| 2,962,542 | 11/1960 | Witt | 174/92 X |
| 4,192,114 | 3/1980 | Jungwirth et al. | 52/223.13 |
| 4,442,646 | 4/1984 | Prevedini | 52/223.13 |
| 5,072,558 | 12/1991 | Sorkin | 52/230 |
| 5,442,140 | 8/1995 | Mc Grane | 174/93 X |

FOREIGN PATENT DOCUMENTS

| | | | |
|---|---|---|---|
| 68251 | 6/1977 | Australia | 52/223.13 |
| 775744 | 5/1957 | United Kingdom | 52/223.13 |
| 1413569 | 11/1975 | United Kingdom | 52/223.13 |

OTHER PUBLICATIONS

VSL Corporation, VSL Post-Tension Systems, Mar. 1994, pp. 4–15.

*Primary Examiner*—Wynn E. Wood
*Assistant Examiner*—Laura A. Saladino

[57] ABSTRACT

A transition apparatus for a bonded slab post-tension system including a diverter member having a first end and a second end and a tendon port support affixed to the second end of the diverter member. The first end of the diverter member is attached to a duct. The tendon port support has a plurality of tendon ports opening at an end opposite the diverter member. The second end of the diverter member has a greater area than the first end. Each of the tendon ports is of a tubular configuration opening at one end to an interior of the diverter member. A plurality of tubular members are affixed to the plurality of tendon ports and extend outwardly therefrom. A plurality of anchors are attached to the plurality of tubular members at an end opposite to the plurality of tendon ports.

17 Claims, 2 Drawing Sheets

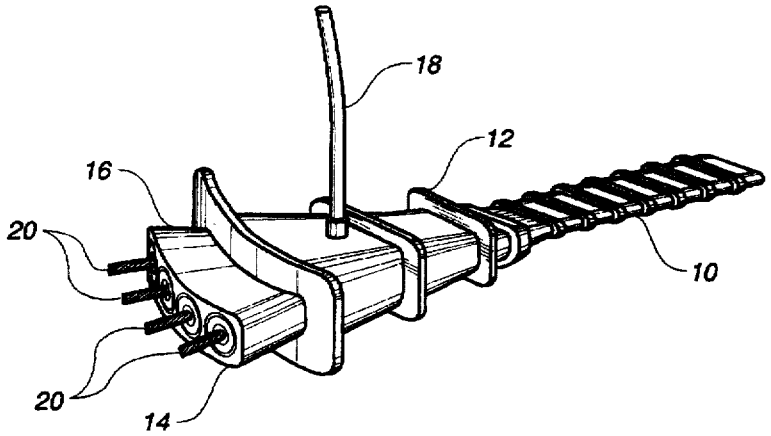
FIG. 1
PRIOR ART
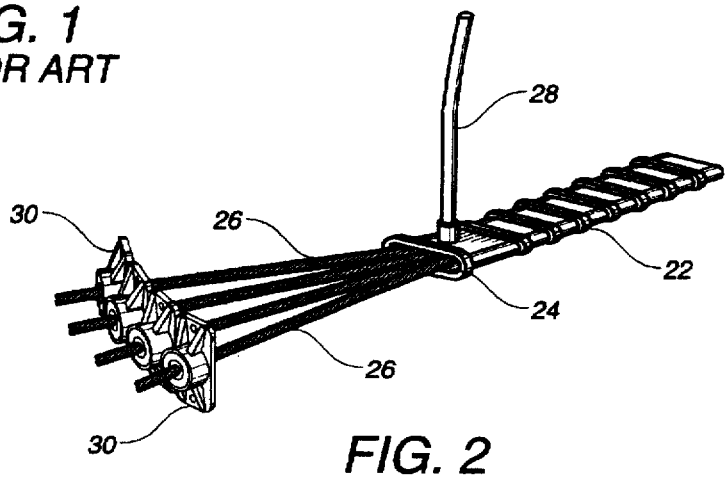
FIG. 2
PRIOR ART
FIG. 3
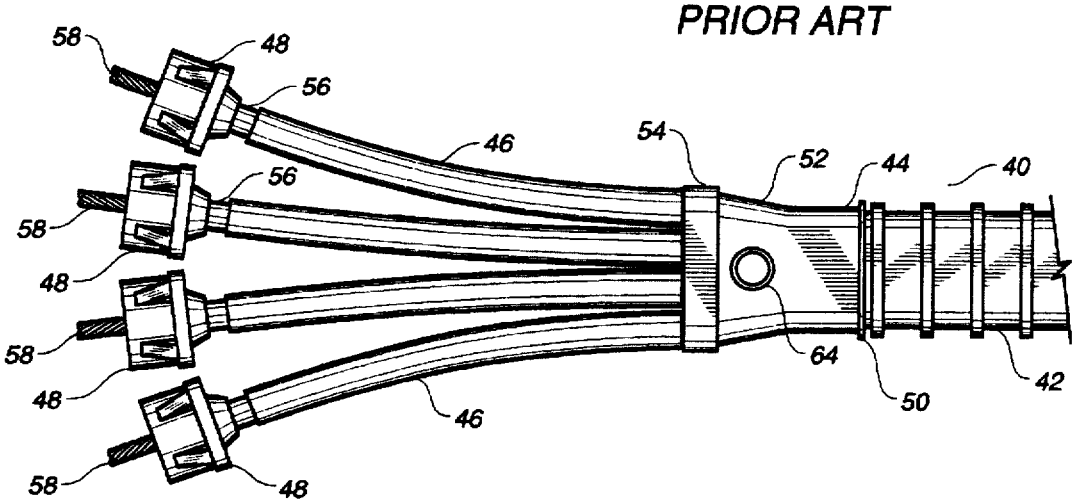

BONDED SLAB POST-TENSION SYSTEM

TECHNICAL FIELD

The present invention relates to post-tension systems, in general. More particularly, the present invention relates to bonded slab post-tension systems. More particularly, the present invention relates to systems of encapsulating tendons and other items so as to isolate such items from the surrounding concrete.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Multi-strand tensioning is used when forming especially long post-tensioned concrete structures, or those which must carry especially heavy loads, such as elongated concrete beams for buildings, bridges, highway overpasses, etc. Multiple axially aligned strands of cable are used in order to achieve the required compressive forces for offsetting the anticipated loads. Special multi-strand anchors are utilized, with ports for the desired number of tensioning cables. Individual cables are then strung between the anchors, tensioned and locked as described above for the conventional monofilament post-tensioning system.

As with monofilament installations, it is highly desirable to protect the tensioned steel cables from corrosive elements, such as de-icing chemicals, sea water, brackish water, and even rain water which could enter through cracks or pores in the concrete and eventually cause corrosion and loss of tension of the cables. In multi-strand applications, the cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections is sealed at each end to an anchor and between adjacent sections of duct to provide a water-tight channel. Grout then may be pumped into the interior of the duct in surrounding relationship to the cables to provide further protection.

FIGS. 1 and 2 show two examples of current bonded slab post-tensioning systems. Each of these prior art systems are sold by VSL Corporation of Raleigh, N.C. FIG. 1 illustrates a product known as "VSL Type SA Anchorage". In this system, a duct 10 is affixed to the end of a cast anchor structure 12. The anchor structure has a plurality of passageways therein which serve to allow the tendons from the duct 10 to emerge at the end 14 of the anchor head 16. A grout tube 18 is connected to the anchor structure 12 so as to allow grout to be introduced into the interior of the bearing plate and also into the interior of the duct 10. This apparatus utilizes an extremely expensive machined casting. In normal use, each of the tendons 20 at the end 14 of the anchor head 16 are tensioned after the exterior of the bearing plate 12 and the duct 10 are bonded in concrete. After the tensioning occurs, grout is introduced into the interior so as to cement the tendons. In this manner, it is intended to create a sealed system so that the tendons are properly retained in a tensioned condition.

Unfortunately, the cost of the anchor head 16 and anchor structure 12 is exceedingly expensive. Furthermore, the exterior of the anchor head and bearing plate can be subjected to corrosion when exposed to water, and other elements, which may leach through the concrete. Ultimately, with sufficient corrosion, the integrity of the anchor head can be impaired.

FIG. 2 shows an alternative system known as the "VSL Type N Anchorage". As can be seen in this system, a duct 22 is formed so as to have an interior area 24 through which tendons 26 extend. As shown in FIG. 2, four tendons 26 extend through the duct 22 and outwardly therefrom. A grout tube 28 is connected to the duct 22 so as to allow for the introduction of grout therein. In normal use, the anchors 30 are connected to each of the tendons 26 so as to serve as "dead end" anchors. FIG. 1, on the other hand, shows a "live end" anchor. In normal use, when the tendons 26 are tensioned, they will be exposed to the concrete on the exterior and will bond therewith. After the bonding with the concrete has occurred, it is virtually impossible to stress the tendons subsequently. Additionally, the exposed tendons 26 can corrode after exposure to the elements in the concrete. Furthermore, the anchors 30 can also corrode over time. Both FIGS. 1 and 2 show systems in which certain elements of the bonded slab post-tensioning system are exposed to the elements in the concrete. Neither of these systems offer a completely encapsulated system.

It is an object of the present invention to provide a bonded slab post-tensioning system which is relatively inexpensive.

It is another object of the present invention to provide such a system in which all of the components of the system are encapsulated.

It is still a further object of the present invention to provide such a system which is easy to install and easy to use.

It is still a further object of the present invention to provide such a system which is useful for either live end or dead end anchorages.

These and other objects and advantages of the present invention will become apparent from a reading of the attached specification and appended claims.

SUMMARY OF THE INVENTION

The present invention is a bonded slab post-tension system that comprises a plurality of tendons, a duct extending around the plurality of tendons, a transition member connected to the duct and extending around the plurality of tendons, a plurality of tubular members affixed to a plurality of tendon ports formed on the transition member, and a plurality of anchors which are attached to an end of the plurality of tubular members. The plurality of tendon ports are formed on the transition member at an end opposite the duct. The plurality of tendons extend through the plurality of tubular ports and through the plurality of tubular members. The plurality of tendons are affixed to the plurality of anchors.

In the present invention, each of the plurality of tubular members is attached to a separate one of plurality of tendon ports. Also, each of the plurality of tendons extends through separate tendon ports. Each of the plurality of anchors is attached to a separate tubular members. Each of the plurality of tendons is attached to a separate anchor. The duct, the transition member and the plurality of tubular members are formed of a polymeric material. The duct, the tubular members and the transition member are connected together in liquid-tight relationship.

The transition member includes a tendon diverter having a first end connected to the duct, and a port support affixed to a second end of the tendon diverter. The plurality of tendon ports are formed at an end of the port support opposite the tendon diverter. The second end of the tendon diverter has a greater area than the first end. The port support and the tendon ports are formed of a more pliable polymeric material than the tendon diverter. A grout means is formed on a surface of the transition member so as to allow for the passing of a grout material into an interior of the transition member. Each of the plurality of tubular members has an inner diameter slightly greater than an outer diameter of each of the plurality of tendon ports such that each of the plurality of tubular members is slidably received on an exterior surface of the plurality of tendon ports.

Each of the anchors is an encapsulated anchor which includes a tubular extension extending outwardly therefrom. The tubular extension is slidably received within the interior of the tubular member. The tendon port, the tubular member, and the tubular extension of the anchor form a single tendon passageway.

BRIEF DESCRIPTION OF THE DRAWINGS

FIGS. 1 and 2 show prior art examples of bonded slab post-tensioning systems.

FIG. 3 is a plan view of the system in accordance with the preferred embodiment of the present invention.

DETAILED DESCRIPTION OF THE INVENTION

Figure 4:
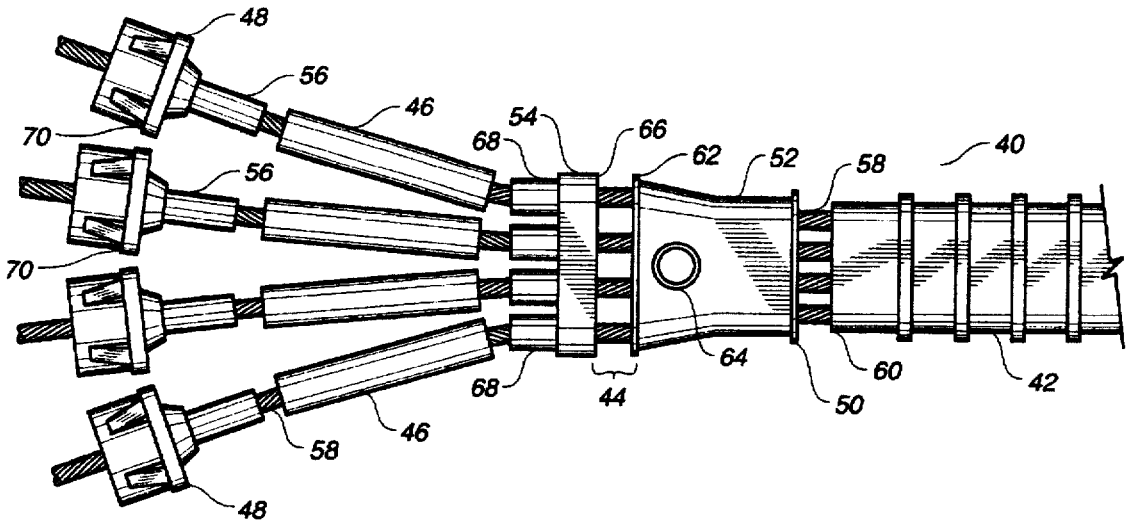
FIG. 4 is an exploded view of the system of the present invention with each of the components of the system are shown as separated along lengths of the multiple tendons.

Referring to FIG. 3, there is shown at 40 the bonded slab post-tensioning system in accordance with the preferred embodiment of the present invention. The system 40 includes a duct 42, a transition member 44, a plurality of tubular members 46, and a plurality of anchors 48. The transition member 44 has a first end 50 attached, in liquid-tight relationship, to an end of the duct 42. The tubular members 46 have an end which is affixed to separate ports (shown in FIG. 4) formed on an end of the transition member 44 opposite the duct 42. Additionally, the anchors 48 are received by an end of the tubular members 46 opposite the transition member 44. Each of the elements is connected together in generally liquid-tight relationship.

The duct 42, as described herein, is a flat duct which extends around a plurality of tendons therein. Since the present invention is also applicable to round ducts, the illustration of the flat duct 42 is not intended as a limitation herein. The end 50 of the transition member 44 can be snap fitted, or otherwise affixed, to the end of the duct 42.

The transition member 44 includes a diverter member 52 and a port support 54. The port support 54 is connected to a wide end of the tendon diverter 52 opposite the duct 42. The tendon diverter 52 allows the tendons, on the interior of the transition member 44 to spread outwardly. The port support 54 includes a plurality of tendon ports formed on an end opposite the duct 42. The tendon ports (shown in detail in FIGS. 4 and 5) allow the individual tendons to extend therethrough. So as to facilitate the ease of allowing the tendons to extend through the ports of the port support 54, the port support 54 is formed of a more pliable polymeric material than that of the material which is used for the tendon diverter 52. As such, cracking, or other damage, to the port support 54 and the associated tendon ports can be avoided. Additionally, since the port support 54 and the tendon ports are very pliable and flexible, the tendons can be easily "threaded" through the ports.

The tubular members 46 are polymeric tubes which have a diameter slightly greater than the diameter of the tendons extending therethrough. One end of the tubular members 46 is affixed onto a tendon port of the port support 54. The opposite end of the tubular members 46 is affixed to a tubular extension 56 formed on the anchors 48. In normal use, the tubular members 46 will have an inner diameter which is slightly greater than the outer diameter of the tendon ports of the port support 54 and also which is slightly greater than the outer diameter of the tubular extension 56 of the anchors 48.

In FIG. 3, it can be seen that the tubular extension 56 of the anchors 48 is received in slidable relationship into the interior of the tubular members 46. Each of the anchors 48 includes an anchor body which is encapsulated in plastic material. The tubular extension 56 is formed with the plastic encapsulation. Each of the tendons 58 has an end which emerges from the end of the anchors 48. In this manner, the ends of the tendons 58 are in an appropriate position for stressing. After stressing the tendons 58, the tendons can be cut so that they are retained within the interior of the each of the anchors 48. A sealing cap can then be placed over the end of the anchors 48 opposite the tubular members 46.

FIG. 4 shows the arrangement of each of the components of the system 40 of the present invention. It can be seen that the duct 42 extends around the plurality of tendons 58. The end 60 of the duct 42 can be snap-fitted or otherwise attached to the end 50 of the tendon diverter 52. The tendon diverter 52 has an opening at the end 50 so as to allow the entry of the tendons 58. The opposite end 62 has a greater area than the end 50 so as to allow for the expansion and spreading of the tendons 58. As can be seen, the tendon diverter 52 spreads angularly outwardly from the end 50. It is desirable that the tendon diverter 52 be of a relatively rigid polymeric material so as to retain the tendons 58 within a confined area. The use of such a rigid polymeric material resists deformation and facilitates the "threading" of the tendons through the tendon ports.

As can be seen in FIG. 4, a grout opening 64 is formed on a surface of the tendon diverter 52. The grout opening 64 allows for the introduction of grout into the interior of the transition member 44 and, thusly, into the interior of the duct 42. The grout opening 64 can be included or omitted depending on the requirements of the post-tension system that uses the present invention.

The port support 54 has an end 66 which can be affixed to the end 62 of the tendon diverter 52. The port support 54 can be snap fitted, or otherwise attached, in liquid-tight relationship onto the tendon diverter 52. A plurality of tendon ports 68 extend outwardly from an end of the port support 54 opposite the tendon diverter 52. Each of the tendon ports 68 has an inner diameter which is greater than the outer diameter of the individual tendons 58. Also, the tendon ports 68 have an outer diameter which serves to receive the inner diameter of the tubular members 46 in liquid-tight relationship therewith.

As can be seen in FIG. 4, each of the tendons 58 extends, as a group, through the tendon diverter 52 and then spreads outwardly so as to pass individually through the port support 54 and through the tendon ports 68. Each of the tendons 58 will then pass through the interior of the tubular members 46 and outwardly therefrom so as to be received by the anchors 48. Each of the anchors 48 includes a tubular extension 56 which is slidably received into the interior of the tubular members 46. Each of the anchors 48 includes an anchor member 70 and a plastic encapsulation extending therearound. The ends of the tendons 58 are conventionally retained within the anchor member through the use of wedges.

Figure 5:
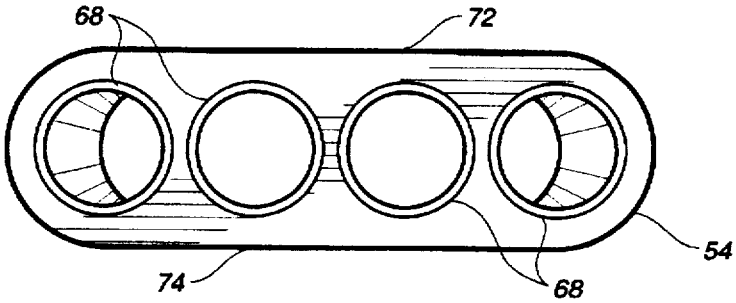
FIG. 5 is an end view of the tendon port support of the present invention.

FIG. 5 shows an end view of the port support 54. In the embodiment of the present invention shown in FIGS. 3 and 4, the duct 42 is a flat duct. As such, the port support 54 will have a profile generally resembling the orientation of the duct 42. In this case, the port support 54 has a generally oval configuration with a flat top 72 and a flat bottom 74. Each of the tendon ports 68 have a tubular configuration. Each of the tendon ports 68 opens to the interior of the tendon diverter 52.

Figure 6:
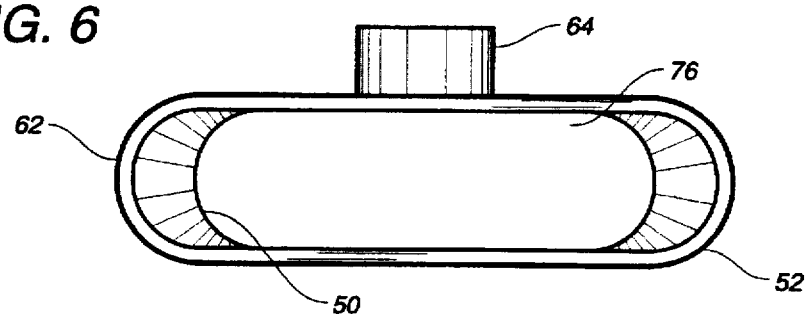
FIG. 6 is an end view of the diverter member of the present invention.

FIG. 6 shows the tendon diverter 52. The tendon diverter 52 has an interior area 76 which communicates with the tendon ports 68. As can be seen in FIG. 6, the interior 76 of the tendon diverter 52 tapers toward end 50. The grout tube 64 also communicates with the interior 76 of the tendon diverter 52. In normal use, the end 62 of the tendon diverter 52 will be received by the end of the port support 54.

In normal use, the present invention offers a number of advantages over conventional and prior art bonded slab post-tensioning system. Most importantly, since each of the components of the system of the present invention is formed of a polymeric material, there is no need for expensive machining or casting of each of the components. Additionally, any of the steel components found within the system of the present invention are encapsulated in plastic so as to avoid deterioration by contact with the elements in the concrete. In the present invention, the tendons 58 are enclosed in the ducts. As such, grout can be effectively pumped into the ducts so as to properly bond with the tendons. Under no circumstances do the tendons of the system 40 of the present invention bond with the concrete of the structure in which the system is placed. The present invention offers a completely sealed system. Since all of the components can be easily fitted together, the installation of the system 40 of the present invention is relatively easy.

In the present invention, the anchors 48, the tubular members 46, and the duct 42 are off-the-shelf items. The use of the tendon diverter 52 and the port support 54 are the components which allows the system of the present invention to function properly. As such, the present invention further facilitates the ability to use conventional, and relatively inexpensive, post-tension components.

The system of the present invention is applicable as either a live end anchorage or a dead end anchorage. If the system is a live end anchorage, then each of the tendons 58 can be tensioned as they extend outwardly of the anchorages 48. If it is a dead end anchorage, then the tendon is retained on the interior of the anchors 48, without the need for tensioning at that end.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A bonded slab post-tension system comprising:

a plurality of tendons;

a duct extending around said plurality of tendons;

a transition member connected to said duct and extending around said plurality of tendons, said transition member having a plurality of tendon ports formed at an end opposite said duct, said plurality of tendons extending through said plurality of tendon ports, said transition member comprising:

a tendon diverter having a first end connected to said duct; and a port support affixed to a second end of said tendon diverter, said plurality of tendon ports formed at an end of said port support opposite said tendon diverter, said port support and said plurality of tendon ports being of a more pliable polymeric material than said tendon diverter;

a plurality of tubular members affixed to said plurality of ports and extending outwardly therefrom, said plurality of tendons extending through said plurality of tubular members; and a plurality of anchors attached to an end of said plurality of tubular members, said plurality of tendons having an end affixed to said plurality of anchors.

2. The system of claim 1, each of said plurality of tubular members attached to a separate one of said plurality of tendon ports, each of said plurality of tendons extending through a separate one of said plurality of tendon ports.

3. The system of claim 2, each of said plurality of anchors attached to a separate one of said plurality of tubular members, each of said plurality of anchors affixed to a separate one of said plurality of tendons.

4. The system of claim 1, said duct, said transition member and said plurality of tubular members being formed of polymeric material.

5. The system of claim 1, said second end of said tendon diverter having a greater area than said first end.

6. The system of claim 1, said transition member having a grout means formed on a surface thereof, said grout means for passing a grout material into an interior of said transition member.

7. A bonded slab post-tension system comprising:

a plurality of tendons;

a duct extending around said plurality of tendons;

a transition member connected to said duct and extending around said plurality of tendons, said transition member having a plurality of tubular tendon ports extending outwardly from an end opposite said duct, said plurality of tendons extending through said plurality of tendon ports;

a plurality of tubular members affixed to said plurality of ports and extending outwardly therefrom, said plurality of tendons extending through said plurality of tubular members, each of said plurality of tubular members having an inner diameter slightly greater than an outer diameter of each of said plurality of tendon ports, each of said plurality of tubular members being slidably received in liquid-tight relationship onto an exterior surface of each of said plurality of tendon ports; and a plurality of anchors attached to an end of said plurality of tubular members, said plurality of tendons having an end affixed to said plurality of anchors, said duct and said transition member and said plurality of tubular members being formed of a polymeric material.

8. A transition apparatus for a bonded slab post-tension system comprising:

a diverter member having a first end and a second end, said first end having means for attachment to a duct; and a tendon port support affixed to said second end of said diverter member, said tendon port support having a plurality of tendon ports thereon, each of said plurality of tendon ports being of a tubular configuration opening at one end to an interior of said diverter member, said tubular configuration extending outwardly from said one end, said diverter member and said tendon port support being formed of a polymeric material.

9. The apparatus of claim 1, said second end of said diverter member having a greater area than said first end.

10. The apparatus of claim 8, said diverter member having grout means formed thereon, said grout means for passing a grout material into an interior of said diverter member.

11. The apparatus of claim 8, said port support and said plurality of tendon ports being of a more pliable polymeric material than said diverter member.

12. The apparatus of claim 8, further comprising:

a plurality of tubular members affixed to said plurality of tendon ports and extending outwardly therefrom, said plurality of tubular members being formed of a polymeric material.

13. The apparatus of claim 12, each of said plurality of tubular members being slidably affixed in liquid-tight relationship onto an exterior surface of each of said plurality of tendon ports.

14. The apparatus of claim 12, further comprising:

a plurality of anchors attached to said plurality of tubular members at an end opposite said plurality of tendon ports.

15. The apparatus of claim 14, each of said plurality of anchors having a tubular extension formed thereon, said tubular extension being slidably received in liquid-tight relationship onto said end of said plurality of tubular members.

16. The apparatus of claim 15, each of said plurality of anchors comprising:

a rigid anchor member; and a polymeric encapsulation extending around said anchor member, said tubular extension formed in said polymeric encapsulation.

17. The apparatus of claim 12, each of said plurality of tendon ports and said plurality of tubular members defining an interior passageway communicating with said diverter member so as to allow a single tendon to pass therethrough.

* * * * *